US006329038B1

(12) United States Patent
Christoffersen

(10) Patent No.: US 6,329,038 B1
(45) Date of Patent: Dec. 11, 2001

(54) INSULATING COVER

(75) Inventor: Henrik Christoffersen, Hjortshoej (DK)

(73) Assignee: Combi-Therm A/S, Them (DK)

( * ) Notice: Subject to any disclaimer, the term of this patent is extended or adjusted under 35 U.S.C. 154(b) by 0 days.

(21) Appl. No.: 09/375,634

(22) Filed: Aug. 17, 1999

(30) Foreign Application Priority Data

Aug. 17, 1998 (EP) ..... 98610027

(51) Int. Cl.[7] ..... B32B 1/04

(52) U.S. Cl. ..... 428/68; 52/3; 52/309.16; 52/785; 52/790; 428/68; 428/70; 428/71; 428/74; 428/75; 428/76; 428/102; 428/103; 428/188

(58) Field of Search ..... 428/68, 70, 71, 428/74, 75, 76, 102, 103, 188; 52/3, 309.16, 785, 790

(56) References Cited

U.S. PATENT DOCUMENTS 5,638,642 * 6/1997 Nemec ..... 52/3

* cited by examiner

*Primary Examiner*—Nasser Ahmad
(74) *Attorney, Agent, or Firm*—Thomas R. Vigil

(57) ABSTRACT

The insulating cover comprises a gas and water impermeable first foil (13) which defines a first circumferential outer rim, a gas and water impermeable second foil (26) substantially coextensive with said first foil (13) and defining a second circumferential outer rim. The first (13) and second foil (26) are joined together at the first and second outer circumferential rims of the first (13) and second outer circumferential rims of the first (13) and second foils (26), to define an enclosure between the first (13) and second (26) foils. A body of insulating material (24) is inserted in the enclosure. A plurality of supporting tubular elements (20) in co-planar relationship with said first (13) and second foil (26) provide a stiffness of the insulating cover (15) in axial direction of the plurality of supporting tubular elements (20) and flexibility of the insulating cover (15) in a direction perpendicular to the axial direction.

24 Claims, 2 Drawing Sheets

Fig. 1
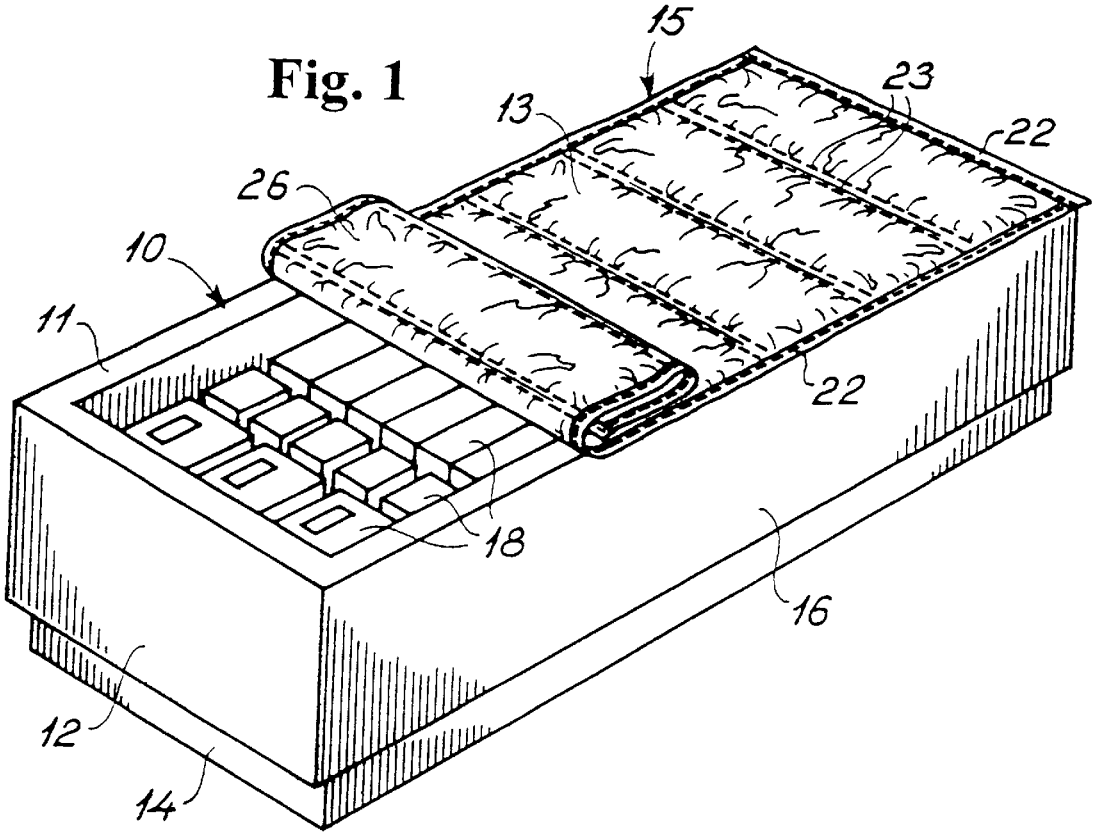
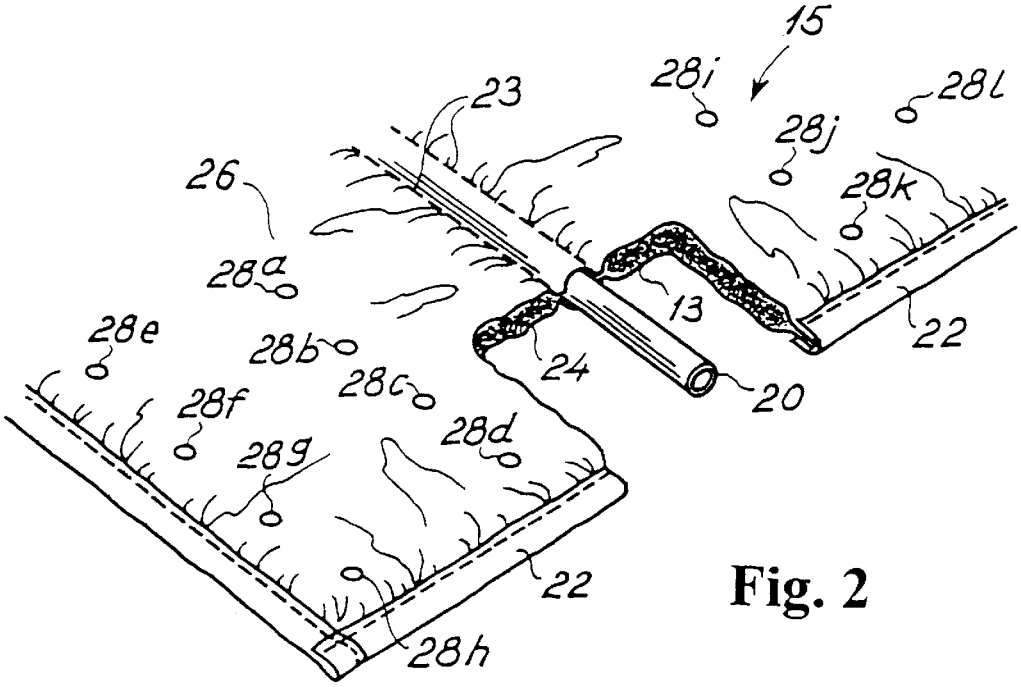
Fig. 2

Fig. 3
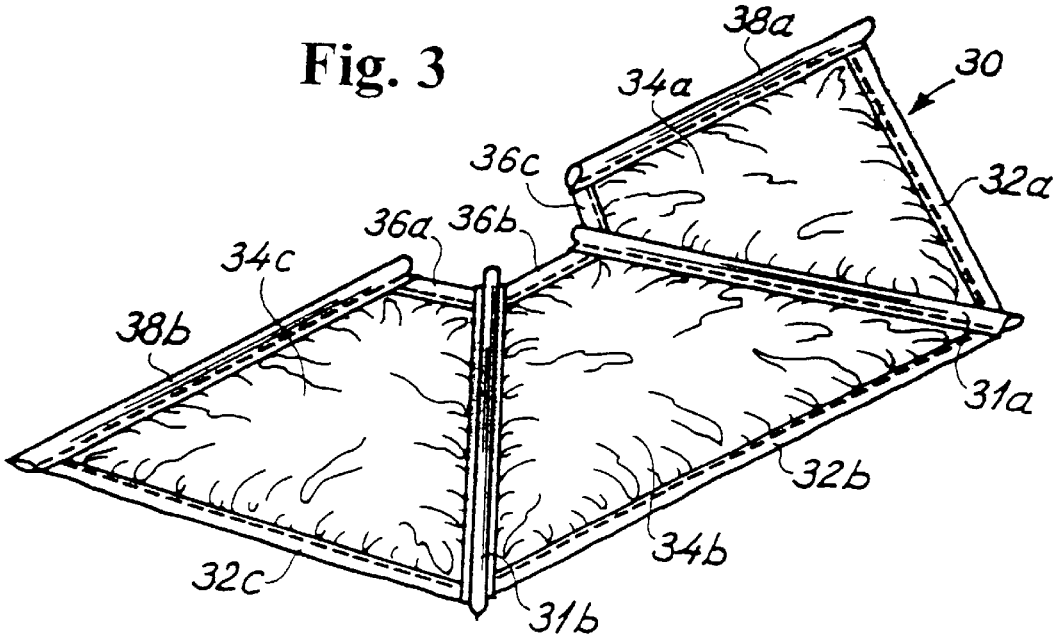
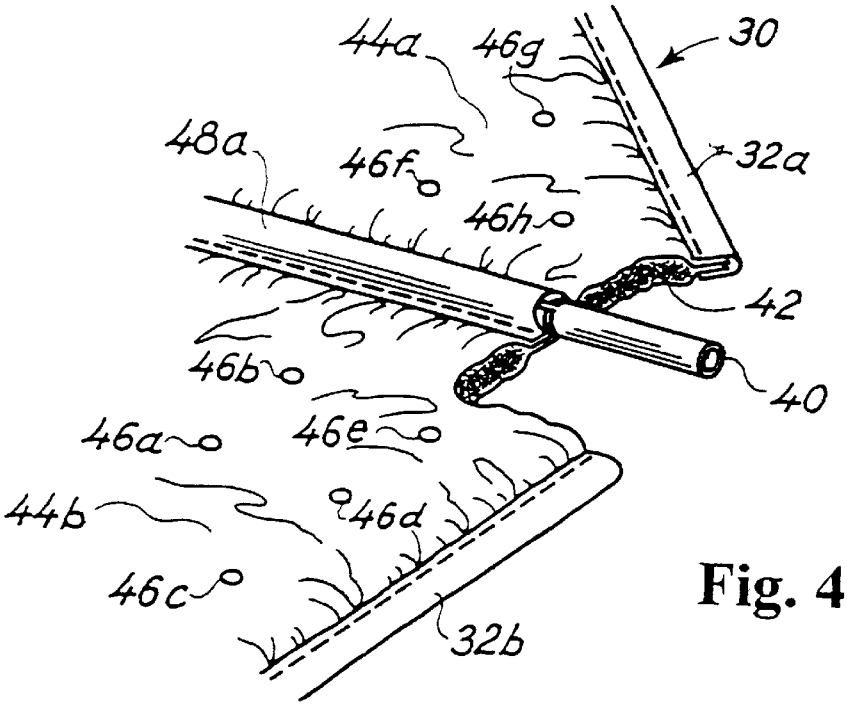
Fig. 4

INSULATING COVER

CROSS-REFERENCE TO RELATED APPLICATIONS

This application claims priority from European Patent Application No. 98610027.9 filed Aug. 17, 1998.

BACKGROUND OF THE INVENTION

1. Field of the Invention

The present invention relates to an insulating cover for open cooling devices, such as refrigerators or deep freezers generally used in stores and supermarkets. In numerous cases refrigerators or deep freezers will not be covered over a longer period of time, e.g. stores selling products that need cooling to maintain freshness, rely on open refrigerators and deep freezers to provide easy accesses for the customers to the produce. However, in the closing hours of these stores the energy consumption can be greatly reduced by applying insulating covers to the openings of these cooling devices.

2. Description of the Prior Art

The conventional technique, used for reducing the energy consumption of cooling devices in the closing hours of stores and supermarkets, applies insulating covers to the openings of refrigerators or deep freezers. Chest refrigerators or chest deep freezers are conventionally covered by self-supporting insulating covers, supported by the edges of the chest refrigerator or chest deep freezer. The conventional self-supporting insulating cover as described in DK patent no.:152602, to which reference hereby is made.

The conventional insulating cover comprises two plastic foils joined at the circumferentially outer rim providing an enclosure for the insertion of insulating material. Rods or beams are mounted to the cover to constitute a self-supporting effect of the insulating cover, however the rods or beam increase the weight of the insulating cover. The rods' or beams' overall weight contribution to the total weight of the insulating cover is considerable compared to of any of the parts included in the cover.

Experience from using conventional technique shows that usage of the conventional insulating cover on top of cooling devices, renders it necessary to insure the insulating material from moving within the enclosure thereby reducing the overall insulating effect of the cover. Therefor a type of fixation is needed to avoid shifting, to any substantial extent, of the insulating material.

BRIEF SUMMARY OF THE INVENTION

An object of the present invention is to provide an easy to handle, durable self-supporting insulating cover having an overall polygonal, semi-circular, circular, semi-elliptic, elliptic or any of above combinatory shape with an improved stiffness and support of the insulating cover.

A feature of the present invention originates from the fact that stitching through the insulating cover insuring the enclosed insulating material from concentrating at any particular areas of the insulating cover can be avoided. This is particularly advantageous because by avoiding through-stitches, thermal bridges between air inside the cooling device and outside the cooling device are eliminated, and by insuring a stable insulating material without through-stitches an enhanced insulation is achieved.

A particular advantage of the present invention relates to the lighter structure of the insulating cover, which renders it easy to handle and carry the insulating cover and therefore provides a more manageable and mobile insulating cover.

The above object, feature and advantage together with numerous other objects, features and advantages, which will be evident from the below detailed description of preferred embodiments of the insulating cover according to the present invention, comprising:

(a) a gas and water impermeable first foil and defining a first circumferential outer rim, (b) a gas and water impermeable second foil substantially coextensive with said first foil and defining a second circumferential outer rim, said first and second foil being joined together at said first and second outer circumferential rims of said first and second foils, defining an enclosure between said first and second foils, (c) a body of insulating material inserted in said enclosure, and (d) a plurality of supporting tubular elements in co-planar relationship with said first and second foil providing stiffness of said insulating cover in axial direction of said plurality of supporting tubular elements and flexibility of said insulating cover in a direction perpendicular to said axial direction, said plurality of supporting tubular elements having a weight constituting at a maximum 30% of the total weight of the insulating cover, such as a weight within the range of 5% to 25%, preferably 10% to 20% of the total weight.

Using a plurality of supporting tubular elements constitutes a significant reduction of the overall total weight of the insulating covers compared with the conventional covers. This fact insures an easy to handle, manageable and therefore more mobile construction, which reduces the time spend on the application and removal of the insulating covers. Furthermore the plurality of supporting tubular elements provides a greater stiffness of the cover in the axial direction compared to conventional covers using rods or beams, hence constituting a smoother surface of the insulating cover minimising any shifting or slipping of the insulating material inside the insulating cover. Finally the smoother surface reduces the material from concentrating at any particular area of the cover and therefor eliminates the need for through-stitches to fixate the insulating material.

The plurality of supporting tubular elements can have an overall length in the axial direction concordant with length of an insulating cover in that same direction, alternatively the plurality of supporting tubular elements can have an overall length in the axial direction longer than the length of the insulating cover in that same direction, or, finally, the plurality of supporting tubular elements can have an overall length in the axial direction shorter than the length of the insulating cover in that same direction thereby providing the insulating cover with a flexible extenuation allowing the insulating cover to fold about an edge of a cooling device.

The plurality of supporting tubular elements can be fixed to one of the outer surfaces of said first or second foils, or it can be fixed in said enclosure. The plurality of supporting tubular elements can be fixed to said first and/or second foils by gluing, welding, stitching or combinations thereof. Stitching can involve stitching a plurality of bands onto the outer surfaces of first or second foils with two parallel series of stitches leaving a space between them for the insertion of one supporting tubular element in each said space. This wide variety of options allows insulating covers according to the present invention to fulfill numerous of customized solutions and designs to optimized for an enhanced insulation.

The body of insulating material can comprise mineral fibers, plastic fibers, plastic filaments, partly coherent foam spheres, fully coherent foam spheres, any other insulating materials or combinations thereof An embodiment according to the present invention can comprise a body of fully coherent insulating material defining a sheet structure with a circumferentially outer rim. The application of a sheet of insulating material can insure against fibers evading the enclosure, and therefor increase the life span of the insulating cover.

The body of insulating material can be loosely inserted into the enclosure, or it can be fixed in the enclosure by gluing, welding, stitching or any combinations thereof the insulating material to said first and/or second foils. When applying a body of fully coherent insulating material it can be fixed at the circumferentially outer rim of said first and/or second foils by gluing, welding, stitching or any combinations thereof. The first and second foils can be joined at their outer circumferential rims by stitching through a band folded about outer surfaces at said outer circumferential rims of said first and second foils and the circumferentially outer rim of said body of insulating material situated in said enclosure. The latter technique constitutes the possible reduction of production steps and therefor reduction of the production costs.

The insulating cover can have an overall polygonal shape, such as rectangular, trapezoidal, parallelogram, triangular, hexagonal, semi-hexagonal or an overall circular, semi-circular, elliptic, semi-elliptic or any combinations thereof, providing a large variety of shapes of insulating covers of the present invention that can fulfill insulating purposes for a substantial amount of types of cooling devices.

The plurality supporting tubular elements can have an individual supporting tubular element orientated substantially perpendicular to said circumferential outer rim or defining a specific angle with said circumferential outer rim. This feature insures that an optimum support and smooth surface is achieved.

An overall rectangular shaped insulating cover can comprise a multiple of individual modules of insulating covers linked together to form said overall rectangular insulating cover, and an overall hexagonal, circular or elliptic shaped insulating cover can comprise two corresponding semi-hexagonal semi-circular or semi-elliptic shaped individual modules of insulating covers linked together to form said insulating cover. The linking of multiple modules of insulating covers can be permanent or detachable through linking mechanisms such as tape, zippers, buttons, Velcro, magnets or any combinations thereof. The multiple of modules of insulating covers defining a first end of an individual module of insulating cover having a first part of said locking mechanism placed on a first surface of said individual module of insulating cover and a second end of said individual module of insulating cover having a second part of said locking mechanism placed on a second surface of said individual module of insulating cover, multiple modules can be linked through second end of a first module to first end of a second module thereby constituting an overlapping of modules constituting an insulating cover. This feature gives tremendous possibilities for using the cover on top of various cooling devices, furthermore the modular construction will enhance the easy handling and mobility of the insulating cover.

The insulating cover can have dimensions of an area from 0.45 $m^2$ to 50 $m^2$ typical areas being 1.4 $m^2$, 2.7 $m^2$, 4.1 $m^2$ and 5.4 $m^2$, a thickness from 5 mm to 50 mm typical thickness' being 10 mm. Due to the modular features of the present invention the area an insulating cover made according to present invention can assume a significant variety of sizes of areas.

The impermeable first foil can have perforations systematically situated such as to drain accumulated condensed water from said insulating cover. The insulating cover can be arranged on a cooling device having said outer surface of first foil facing the cooling device. This drains any accumulated condensed water from the interior of the insulating and allows the insulating cover to be aired hence allowing vapour to evade the interior.

The first and second foils of the insulating cover can be of impermeable materials e.g. polymers or plastic foil such as PE, PP, PVC or any other types of plastic foils, or metal sheets such as aluminum foil, or any combinations thereof.

BRIEF DESCRIPTION OF THE DRAWINGS

The present invention will now be further described with reference to the drawings, in which FIG. 1 is a schematic illustration of a cooling device covered by a first and presently preferred embodiment of a rectangular insulating cover according to the present invention.

FIG. 2 is a schematic illustration of a magnified section of the first embodiment of the insulating cover also shown in FIG. 1, having a section removed thereby revealing the interior of the cover.

FIG. 3 is a schematic illustration of a section of a second or alternative embodiment of the insulating cover defining an overall semi-hexagonal configuration.

FIG. 4 is a schematic illustration of a magnified section of one of the corners of a modified second or alternative embodiment of the insulating cover defining a semihexagonal embodiment, having a section removed thereby revealing the interior of the cover.

DETAILED DESCRIPTION OF THE INVENTION

As shown in FIG. 1, a cooling device, designated by the reference numeral 10 in it's entirety, being e.g. a chest refrigerator or a chest deep freezer, has two parallel square end walls 12 mounted together with two parallel rectangular side walls 16 with the adjoining walls at right angles to each other. A bottom piece 14 is completing the shape of an open box, allowing for access through the uncovered top to cooled produce 18 arranged within. Fresh meat, dairy products, poultry and fish, or frozen vegetables, ice-cream, precooked dinners or any combinations thereof are examples of the produce 18, but the cooling device 10 can also contain biological products, biological specimens, microbiological cultures, medicine, pharmaceutical products, medical instruments or any combinations thereof. In its entirety the edge of the walls facing away from the bottom piece 14 of the cooling device 10 has a thickness defined by a for refrigerators or freezers typical insulating material being either a single layer, a double layer or a composite of materials, e.g. mineral fibers, PU foam or any other insulating material or combinations thereof, enclosed in sheets of metal e.g. aluminum, zinc, steel, iron, or sheets of plastic materials or glass, or any combinations thereof. The thickness of the walls is providing a top surface 11 for the possible resting, strapping, Velcro-locking, buttoning or magnetic holding of an insulating cover, designated by the reference numeral 15 in it's entirety, onto the cooling device 10.

The cooling device 10 can have the dimensions: width from 0.5 m to 2.5 m, length from 1 m to 20 m and depth 0.5 m to 1 m, having typical dimensions: width 0.9 m, length 1.5 m and depth 0.75 m. The top surface 11 of the cooling device 10 can be slanting up to 45° with respect to the horizontal plane.

The insulating cover 15 comprising an outer impermeable foil 13 and an inner impermeable foil 26 can additionally be extended in an outward direction and folded down onto the outward facing surfaces of the walls of the cooling device 10 hereby obtaining a good insulation.

The insulating cover 15 can be fitted any cooling device 10 either by one full size cover matching the dimensions of the cooling device 10, or it can be fitted any cooling device 10 by constructing a insulating cover 15 from any multiple of modules of insulating covers 15. The modules can be permanently linked together or be detachable. The separation of linked insulating cover 15 modules can be conducted through linking mechanisms like tape, zippers, buttons, Velcro, magnets or any combinations thereof. The linking mechanisms can be situated such that two edges of modules overlap one another, hence recovering full insulating effect. This can effectively be done by having one part of the linking mechanism on the outer surface of a module and the second part of said linking mechanism on the inner surface of an adjoining module The insulating cover 15 of the present invention is a flexible self-supporting construction supported by the top surface 11, defined by the walls of the cooling device 10. The flexibility of the insulating cover 15 allows the cover to be rolled into a cylindrical shape, hence reducing the required storage space for the insulating cover 15. An advantage of the modular constructed insulating cover 15 can be that the handling of the cover and the storage possibilities of the cover are considerably improved.

In the present context, terms, such as inner, outer, bottom and top, relate to the space confined inside the cooling device 10. An inner surface of an object is facing the confined space, all other surfaces of said object are outer surfaces. The term bottom is the part of the cooling device 10 resting on the floor furthermore comprising an inner surface perpendicular to all the inner surfaces of the walls of the cooling device 10. The term top is the part of the cooling device 10, through which access to the confined space is achieved, and further comprising the edges of the walls. Terms such as inward and outward are terms describing surface directions. An inward facing surface is relating to a surface of for example a foil, which is facing an interior space. Outward is relating to the surface facing away from an interior space. The interior of the insulating cover 15 is further described in detail with reference to FIG. 2.

FIG. 2 is illustrating a magnified section of the insulating cover 15, with a section cut away to reveal the interior. Insulating material 24, such as mineral fibers, plastic fibers, plastic filaments, partly coherent foam spheres, fully coherent foam spheres, any other insulating materials or combinations thereof, is positioned between the outer impermeable foil 13 and the inner impermeable foil 26. The insulating material 24 can be loosely inserted between the inner and outer foils or can be glued, welded or stitched onto the outer foil 13 or inner foil 26. The presently preferred embodiment has a sheet of the insulating material 24 fixed between the outer foil 13 and inner foil 26 by gluing, welding or preferably stitching a band 22, folded about the edges of the sheet of the insulating material 24, the inner foil 26 and the outer foil 13 at the full circumference of the insulating cover 15. The inner foil 26 has systematically placed perforations 28*a–l* enabling the possibility for airing the insulating material 24 and hence significantly reducing the amount of condensed water accumulating in the insulating material 24. Furthermore having the perforations 28*a–l* on the inner foil 26 the accumulated condensed water is drained out of the insulating cover 15.

A supporting tubular element 20 can be mounted on the outward facing surfaces of the inner or outer foils 26,13, or can be placed in the space between the insulating material 24 and the inward facing surfaces of the inner foil 26 or the outer foil 13, and can be fixed to either inward or outward facing surfaces by gluing, welding or stitching. FIG. 2 is showing the supporting tubular element 20 between the inward facing surface of the inner foil 26 and the insulating material 24 and fixed by stitches 23 through the inner foil 26.

In a rectangular shaped insulating cover 15, as shown in FIGS. 1 and 2, a number of parallel supporting tubular elements 20 are inserted into the insulating cover 15 creating a low weight, stiff and self-supporting cover. When the insulating cover 15 is supported by the top surface 11 of the cooling device 10, the supporting tubular elements 20 create a smooth surface of the insulating cover 15 minimising any shifting or slipping of the insulating material 24 inside the insulating cover 15, while maintaining the possibility for rolling the cover together about an axis parallel to the supporting tubular elements 20.

A feature of using the supporting tubular elements 20 is, stitching through the insulating cover 15 insuring the insulating material 24 from concentrating at any particular areas of the insulating cover 15 can be avoided. This is particularly advantageous because by avoiding through-stitches, thermal bridges between air inside the cooling device 10 and outside the cooling device 10 are eliminated, and by insuring a stable insulating material 24 without through-stitches an enhanced insulation is achieved.

By implementing supporting tubular elements 20 instead of supporting rods a greater stiffness of the insulating cover 15 is obtained, while the weight of the insulating cover 15 is reduced making the mobility of the insulating cover 15 more manageable.

A second or alternative embodiment according to the present invention is shown in FIGS. 3 and 4 and will in the following be further described in detail. FIG. 3 is illustrating one of two parts of an insulating cover 30 for a hexagonal shaped chest cooling device being either a refrigerator or a deep freezer. The insulating cover 30 comprises three pieces of trapezium shaped outer foils 34*a–c*. Each of the outer foils 34*a–c* can have an insulating material 42, of any of the previously described material types, loosely inserted between inner foils 44*a–c* and the outer foils 34*a–c* or can have the insulating material 42 glued, welded or stitched on to the inward facing surface of the outer foils 34*a–c* or the inward facing surface of the inner foils 44*a–c*. The second or alternative embodiment of the present invention has a sheet of the insulating material 42 fixed between the outer foils 34*a–c* and the inner foils 44*a–c* by gluing, welding or preferably stitching bands 32*a–c* and 36*a–c*, folded about the parallel edges of the insulating material 42, the inner foils 44*a–c* and the outer foils 34*a–c*, thereby producing three trapezium shaped sections. Bands 31*a–b* are folded about the adjoining slanting edges of the three trapezium shaped sections, such that the bands 31*a–b* are in contact with the outer foils 34*a–c* of two adjoining trapezium shaped sections. The bands 31*a–b* are stitched from the outer foil 34*a–c* through the insulating material 42 and inner foil 44*a–c* of the first trapezium shaped section, through the inner foil 44*a–c*, insulating material 42 and outer foil 34*a–c* of the second trapezium section leaving space in the bands 31*a–b* for the insertion of supporting tubular elements 40. The two end edges of the semi-hexagonal shape are fitted with bands 38*a–b* either by gluing, welding or preferably stitching, leaving space in the bands 38*a–b* for insertion of further supporting tubular elements 40.

The supporting tubular elements 40 are inserted into the space in the bands 31*a–b* and 38*a–b* giving the insulating cover 30 a smooth surface and hence achieving similar advantages as described for the first preferred embodiment of the present invention. Alternatively the supporting tubular elements 40 can be fixed onto the outward facing surface of the inner foils 44*a–c* by bands 48*a–d* sewn onto the outward facing surface of the inner foils 44*a–c,* as shown in FIG. 4, using two seems leaving a space between the seems for the insertion of the supporting tubular element 40.

The inner foils 44*a–c* are systematically perforated with holes 46*a–h* hence achieving the same advantages, as the insulating cover 15 described through FIGS. 1 and 2.

The particular cooling device for the insulating cover 30, shown in FIG. 3 and 4, can include a variety of hexagonal dimensions, and comprise a hexagonal surrounding wall and a hexagonal centre. The hexagonal centre being solid hence providing a supporting surface for the insulating cover 30 in conjunction with the outer walls of the cooling device.

The above described preferred embodiments made according to present invention can be used for a variety of purposes including extra insulating covers for upright standing open refrigerators or additional insulating or non-insulating purposes.

EXAMPLE

The preferred embodiment of the cover according to the present invention described above with reference to FIGS. 1 and 2, was made as follows.

The rectangular insulating cover 15 had the overall dimensions: length 1250 mm, width 910 mm, average thickness 5 mm, with 2 supporting tubular elements each having a diameter of approximately 10 mm and separated by a distance of 600 mm. The first supporting tubular 20 element placed at a distance of 325 mm from one edge of the insulating cover parallel to the axis of the supporting tubular elements and the second supporting tubular 20 element placed at a distance of 925 mm from said edge. The supporting tubular elements 20 were fixed using through-stitches 23 separated by 25 mm.

The outer foil was impermeable and made of the material PE and had an average thickness of 120 $\mu$m. The inner foil was impermeable and made of the same materials as the outer foil and also had an average thickness of 120 $\mu$m. The inner foil was perforated with holes 28*a–l* with a diameter of 6 mm through the inner foil at widthwise separations of 82 mm and lengthwise separations of 200 mm. The first perforation, for instance 28 h, positioned 27 mm from the edge defining the width of the insulating cover 15 and 35 mm from the edge defining the length of the insulating cover 15. The band 22 holding the foils together was made of the material PVC, but can be any such as PE, PP or cotton, and had the width 36 mm and was folded about the edges of the two foils and a sheet of insulating material 24 and stitched with a polyester thread. The insulating material was polyester.

What is claimed is:

1. An insulating cover for covering the opening at the top of an open top, cold foodstuff, display/storage container comprising:

(e) a gas and water impermeable first foil having a peripheral outer margin defining a first circumferential outer rim, (f) a gas and water impermeable second foil substantially coextensive with said first foil having a peripheral outer margin defining a second circumferential outer rim, said first and second foils being joined together at said first and second outer circumferential rims of said first and second foils with an enclosure defined between said first and second foils, (g) a body of insulating material inserted in said enclosure, and (h) a plurality of supporting tubular elements in co-planar relationship with said first and second foil to provide stiffness to said insulating cover in an axial direction of said plurality of supporting tubular elements and flexibility to said insulating cover in a direction perpendicular to said axial direction, said plurality of supporting tubular elements having a weight constituting no more than 30% of the total weight of the insulating cover and said tubular elements having a length in the axial direction which is one of coextensive with, shorter than or longer than the length in the axial direction of said insulating cover.

2. The insulating cover according to claim 1, wherein said plurality of supporting tubular elements have an overall length in said axial direction shorter than the length of said insulating cover in said axial direction, thereby to provide said insulating cover with a flexible extenuation allowing said insulating cover to fold about an edge of the cold foodstuff display/storage container.

3. The insulating cover according to claim 1, wherein said plurality of supporting tubular elements are fixed to one of the outer surfaces of said first or second foils.

4. The insulating cover according to claim 1, wherein said plurality of supporting tubular elements are fixed in said enclosure.

5. The insulating cover according to claim 1, wherein said plurality of supporting tubular elements are fixed to said first and/or second foils by one of gluing, welding, stitching or a combination thereof.

6. The insulating cover according to claim 5, wherein said stitching includes stitching a plurality of bands onto the outer surfaces of one of the first or second foils with two parallel series of stitches leaving a space between them for the insertion of one supporting tubular element in each said space.

7. The insulating cover according to claim 1, wherein said body of insulating material comprises at least one of mineral fibers, plastic fibers, plastic filaments, partly coherent foam spheres, fully coherent foam spheres, or a combination thereof.

8. The insulating cover according to claim 7, wherein said body of insulating material comprises a fully coherent insulating material of a sheet structure defining a circumferentially outer rim.

9. The insulating cover according to claim 1, wherein said body of insulating material is loosely inserted in said enclosure.

10. The insulating cover according to claim 1, wherein said body of insulating material is fixed in said enclosure by one of gluing, welding, stitching or a combination thereof and said insulating material is fixed to at least one of said first and second foils.

11. The insulating cover according to claim 10, wherein said body of fully coherent insulating material is fixed at said circumferentially outer rim of at least one of said first and second foils by gluing, welding, stitching or a combination thereof.

12. The insulating cover according to claim 1, wherein said first and second foils are joined at said outer circumferential rims of said first and second foils by stitching through a band folded about an outer surface at said outer circumferential rims of said first and second foils and said circumferentially outer rim of said body of insulating material is situated in said enclosure.

13. The insulating cover of claim 1, wherein said insulating cover has one of a polygonal shape selected from one of a rectangular, trapezoidal, parallelogram, triangular, hexagonal, semi-hexagonal shape or a curved shape selected from one of an overall circular, semi-circular, elliptic, semi-elliptic or a combination thereof.

14. The insulating cover of claim 1, wherein said plurality of supporting tubular elements have an individual supporting tubular element orientated at a specific angle selected from one of a substantially perpendicular angle to said circumferential outer rim or a specific angle with said circumferential outer rim.

15. The insulating cover according to claim 1, wherein said insulating cover has a rectangular shape and comprises a multiple of individual modules of insulating covers linked together to form said rectangular insulating cover.

16. The insulating cover according to claim 1, wherein said insulating cover has one of a hexagonal, circular or elliptic shape and comprises two corresponding shaped structures selected from semi-hexagonal, semi-circular or semi-elliptic shaped individual modules of insulating covers linked together to form said insulating cover.

17. The insulating cover according to claim 1, herein said linking of multiple modules of insulating covers being one of permanent or detachable by means of linking mechanisms selected from tape, zippers, buttons, hook and loop connecting structures, magnets or a combination thereof.

18. The insulating cover according to claim 17, wherein said multiple of modules of insulating covers define a first end of an individual module of an insulating cover which has a first part of said locking mechanism placed on a first surface of said individual module of insulating cover and a second end of said individual module of insulating cover having a second part of said locking mechanism placed on a second surface of said individual module of insulating cover, with multiple modules being linked together through connection of a second end of a first module to a first end of a second module thereby forming an overlapping of modules to provide said insulating cover.

19. The insulating cover according to claim 1, wherein said insulating cover has an areal extent of between 0.45 $m^2$ and 50 $m^2$ and a thickness of from 5 mm to 50 mm.

20. The insulating cover according to claim 1, wherein said impermeable first foil has perforations which are systematically situated for draining accumulated condensed water from said insulating cover.

21. The insulating cover according to claim 1, wherein said insulating cover is arranged on the cold foodstuff display/storage container with said outer surface of said first foil facing the cold foodstuff display/storage container.

22. The insulating cover according to claim 1, wherein said first and second foils are made of impermeable materials selected from polymers or plastic foils including Polyethylene, Polypropylene, Polyvinyl chloride or metal sheets including aluminum foil, or a combination thereof.

23. The Insulating cover of claim 1 wherein said tubular elements constitute between 5 and 25% of the weight of said insulating cover.

24. The Insulating cover of claim 1 wherein said tubular elements constitute between 10 and 20% of the weight of said insulating cover.

* * * * *